United States Patent [19]

Nilssen

[11] Patent Number: 4,712,019

[45] Date of Patent: Dec. 8, 1987

[54] PROGRAMMABLE ELECTRONIC PLUG-IN TIMER

[76] Inventor: Ole K. Nilssen, Caesar Dr., Barrington Hills, Ill. 60010

[21] Appl. No.: 721,670

[22] Filed: Apr. 10, 1985

[51] Int. Cl.[4] ..... H01H 43/00

[52] U.S. Cl. ..... 307/141; 307/141.4; 307/141.8; 307/66

[58] Field of Search ..... 307/141.4, 141, 141.8, 307/130, 132, 125, 112, 116, 66, 140; 364/143–147

[56] References Cited

U.S. PATENT DOCUMENTS

| | | | |
|---|---|---|---|
| 4,112,313 | 9/1978 | Kutin | 307/141 X |
| 4,145,617 | 3/1979 | Lee et al. | 307/141 X |
| 4,360,739 | 11/1982 | Goldstein | 307/140 X |
| 4,570,216 | 2/1986 | Chan | 307/141.4 X |
| 4,588,901 | 5/1986 | Maclay et al. | 307/125 |

*Primary Examiner*—William M. Shoop, Jr.
*Assistant Examiner*—Sharon D. Logan

[57] ABSTRACT

A plug-in timer has a set of input terminals and a set of output terminals as well as a contactor operable to make and/or break electrical connection between these sets of terminals in accordance with a pre-setable 24 hour program. The timer is powered from a small built-in battery, and comprises its own quartz clock and programming-and-control means. The contactor is actuated by a miniature DC motor through a gear and cam arrangement. The operation of the DC motor is controlled by the programming-and-control means, which provides power from the battery to the motor in accordance with a pre-set program; which pre-set program may be modified at any time by way of a keyboard and a numeric display means.

The contactor operates by way of hard metal contacts and very little power dissipation occurs within the timer. The timer can be plugged into an ordinary household electrical receptacle, and a load may be plugged into the timer. The timer will then operate to control the flow of power to this load in accordance with the pre-set program.

Since the timer has its own built-in source of energy and clock, its operation is totally independent of the power line, and it will therefore not be affected by a power failure. With a usage rate of two CONNECT-actuations and two DISCONNECT-actuations per day, plus occasional over-rides, the battery will last for years before needing replacement.

20 Claims, 4 Drawing Figures

PROGRAMMABLE ELECTRONIC PLUG-IN TIMER

BACKGROUND OF THE INVENTION

Field of Invention

The present invention relates to a plug-in timer adapted to be plugged into an ordinary household electric receptacle and operable to programmably control the flow of power to a load plugged into the timer.

SUMMARY OF THE INVENTION

Brief Description

In its preferred embodiment, subject invention constitutes a self-contained programmable plug-in timer having a set of input terminals and a set of output terminals as well as a mechanical contactor means operable to make and/or break electrical connection between these sets of terminals in accordance with a pre-setable 24-hour program. The timer is powered from a small built-in battery, and comprises its own quartz clock and clock-based programming-and-control means. The contactor is actuated by a miniature DC motor through a gear and cam arrangement. The operation of the DC motor is controlled by the programming-and-control means, which provides power from the battery to the motor in accordance with a pre-set program. To provide for accurate positioning of the cam, thereby to achieve proper operation of the contactors, a cam position sensing means is used to provide position control information to the programming-and-control means.

The pre-set program may be modified at any time by way of a keyboard and an electronic numeric display means. When not being used for programming, the display means shows current time-of-day.

The timer has plug means and receptacle means, and may be plugged into an ordinary household electrical receptacle. The power plug from a load may be plugged into the timer's receptacle means, thereby to permit programmable control of power provided to this load.

Since the electrical connection made by the contactor is made by way of hard metal contacts. very little power dissipation takes place within the timer, and the amount of power that the timer can safely control is therefore relatively large.

Since the timer has its own built-in source of energy and accurate clock, its operation is totally independent of the power line and will therefore not be affected by a power failure—however long.

The timer has an auxiliary telephone-type receptacle by which it can receive over-ride commands from a remote location.

Based on an anticipated usage rate of two CONNECT-actuations and two DISCONNECT-actuations per day, plus occasional over-rides, the battery will last for years before needing replacement.

BRIEF DESCRIPTION OF THE DRAWINGS

FIG. 1*a* shows a view predominantly from the rear; and FIG. 1*b* shows a view predominantly from the front.

DESCRIPTION OF THE PREFERRED EMBODIMENT

Details of Construction

FIG. 1*a* shows a view predominantly from the rear of the timer. Positioned substantially in the middle of the upper half of the rear of timer T is a pair of prongs P1 and P2 operable to be plugged into and held by an ordinary household electrical receptacle. Positioned in the middle of the bottom of the timer are two repectacle slots RS1 and RS2 operable to receive and hold an ordinary electrical power plug. On the left side of the timer is located a telephone-type receptacle TR operable to receive and hold a telephone-type connector means.

FIG. 1*b* shows a view predominantly from the front of the timer. Positioned near the top of the front is a numeric display means NDM. Positioned below this display means are two relatively large-size program over-ride keys PORK1 and PORK2; and below these over-ride keys is located a set of nine calculator-type programming keys PK1 to PK9.

Figure 2:
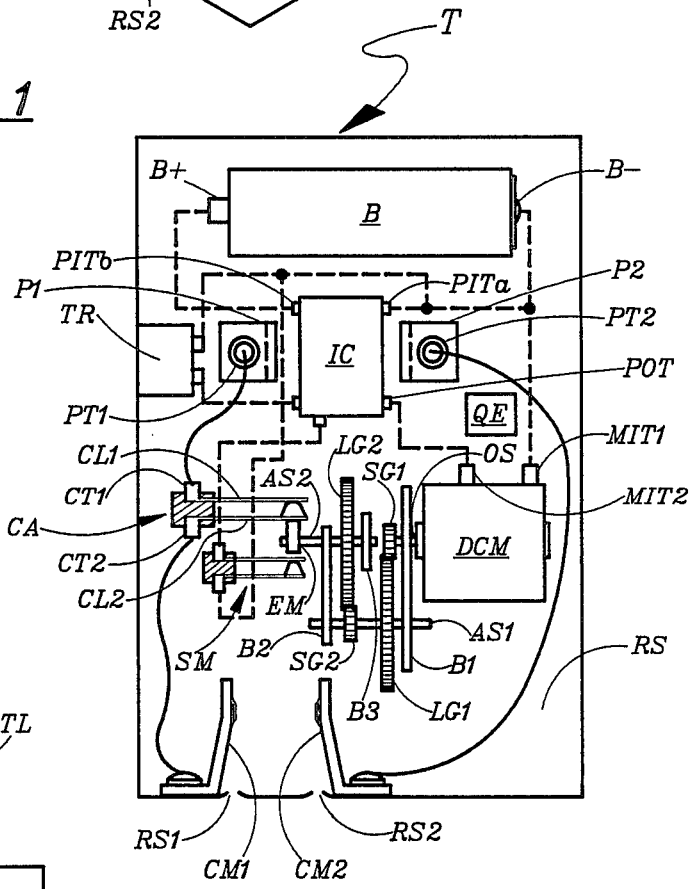
FIG. 2 represents a frontal view of the key components comprised within the timer.

FIG. 2 shows a schematic frontal view of the inside of the timer. A miniature DC motor DCM has two electrical power input terminals MIT1 and MIT2 and is mounted onto a first bracket B1 that is fastened to rear surface RS. On the output shaft OS of this DC motor is mounted a first small gear SG1. This first small gear SG1 is engaged with a first large gear LG1; which first large gear is mounted on a first auxiliary shaft AS1 that is rotatably mounted between first bracket B1 and a second bracket B2 that is also fastened to rear surface RS. Also mounted onto auxiliary shaft AS1 is a second small gear SG2.

Second small gear SG2 is engaged with a second large gear LG2 mounted on a second auxiliary shaft A2; which second auxiliary shaft is rotatably mounted between second bracket B2 and a third bracket B3, also fastened onto rear surface RS.

Mounted onto an extension of second auxiliary shaft AS2 is a cam or an eccentric means EM that operates a contactor assembly CA that consists of a first contactor lever CL1 and a second contactor lever CL2. Eccentric means EM, which is made of electrically non-conductive material, is shown in a position wherein it causes first contactor lever CL1 to come into contact with second contactor lever CL2.

Eccentric means EM also operates a switch means SM, which is located in a position on the other side of eccentric means EM as compared with the location of contactor assembly CA.

As output shaft OS rotates, contactor lever CL1 makes contact with contactor lever CL2 one time for each revolution of eccentric means EM. Similarly, switch means SM is actuated once for each revolution of eccentric means EM.

Contactor assembly CA has two contactor terminals CT1 and CT2. Terminal CT1 is electrically connected with a prong terminal PT1 of prong P1, and terminal CT2 is electrically connected with contact means CM1 associated with receptacle slot RS1. A prong terminal PT2 of prong P2 is electrically connected with a contact means CM2 associated with receptacle slot RS2.

Switch means SM has two terminals, both of which are connected with an integrated circuit IC.

A battery B is positioned above prong terminals PT1 and PT2. This battery has a B− terminal and a B+ terminal, with the B− terminal being of negative polarity with respect to the B+ terminal. The B− terminal is electrically connected with motor input terminal MIT1; the B+ terminal is connected with integrated circuit IC.

Integrated circuit IC and a quartz element QE are located below battery B—in a position that would be relatively close to the numeric display means NDM of FIG. 1*b*. This IC has a relatively large number of electrical terminals, most of which are connected with the quartz element QE, the numeric display means NDM, the programming keys PK1 to PK9, and the programover-ride keys PORK1 and PORK2. However, for sake of clarity, and also since they form no part of the present invention, the detailed electrical connections between the IC and QE, NDM, PK1 to PK9, PORK1 and PORK2 are not shown.

The detailed design and construction of a programmable clock means based on a quartz-controlled IC and an electronic numeric display means is well known from prior art.

The remaining IC electrical terminals and connections are shown: electrical power input terminals PITa is electrically connected with battery terminal B−; electrical power input terminal PITb is electrically connected with battery terminal B+; electrical power output terminal POT is electrically connected with motor input terminal MIT2; the two terminals of switch means SM is connected with two terminals on the IC, one of which is the PITa terminal and the other one of which is a first control input terminal; and the two terminals of telephonetype receptacle TR is likewise connected with two terminals on the IC, one of which is the PITa terminal and the other one of which is a second control input terminal.

Figure 1:
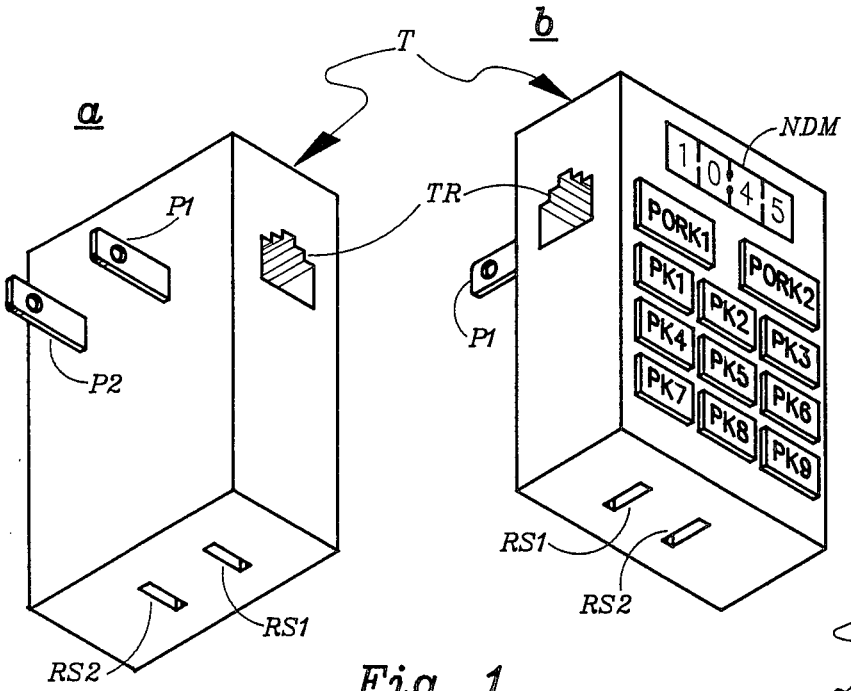
FIG. 1 shows the timer in two perspective views.

To permit the size and shape of the timer to be as compact as desired, which degree of compactness is indicated by FIG. 1, it is important that the individual components comprised within the timer be fittingly small. In practical reality, this concern is only important in respect to the battery and the motor.

Thus, the electrical power required to be supplied from the built-in battery must be modest enough to permit this battery to be small enough to reasonably fit within the desired specified dimensions of the timer. Similarly, the mechanical power required to be supplied by the built-in motor must be modest enough to permit this motor to be small enough to reasonably fit within the specified dimensions.

Since a certain amount of energy is required to effect proper actuation of the contactor assembly, the power required is inversely proportional to the time allowed to effect this actuation. Thus, by way of a speed-reducing gear mechanism, it becomes possible to actuate the control lever at an arbitrarily small power level.

By allowing complete actuation of the contactor assembly, from its full-contact or fully-ON position to its no-contact or fully-OFF position, to take about one second from start to finish, the motor power output requirement gets to be acceptably modest; and actuation can then readily be accomplished by way of a substantially conventional miniature DC motor of dimensions no larger than 10 mm×20 mm×20 mm. Correspondingly, the electrical power required by the motor now becomes adequately modest to permit the use of a single ordinary AAA-cell for the built-in battery.

Figure 3:
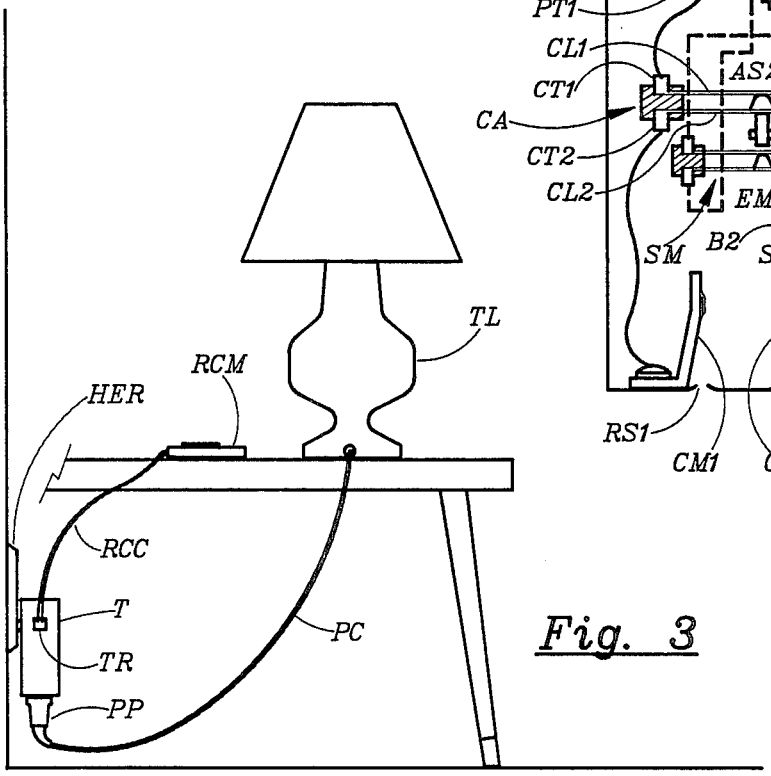
FIG. 3 shows an anticipatedly typical usage situation for the timer.

FIG. 3 shows timer T plugged into an ordinary household electrical receptacle HER, a remote control means RCM plugged into the timer's telephone-type receptacle TR by way of remote control cord RCC, and a table lamp TL plugged into the timer by way of an ordinary power cord PC and ordinary power plug PP.

Details of Operation

With reference to FIGS. 1, 2 and 3, the overall operation of the timer may be explained as follows.

The timer may be programmed by way of programming keys K1 to K9 to cause the IC to actuate and/or de-actuate the DC motor in such a way as to cause contactor assembly CA to make and/or break electrical contact between prong P1 and contact means CM1 in accordance with a desired time pattern; which time pattern will then automatically repeat every 24-hour period.

Thus, if the timer is plugged into an ordinary household electrical receptacle by way of its prongs P1 and P2, and if a power plug from an electrical load is plugged into the timer by way of its receptacle slots RS1 and RS2, then the load will be connected and/or disconnected from the household electrical receptacle in accordance with this desired time pattern.

With reference to FIG. 2, when the DC motor is provided with a DC voltage across its electrical input terminals, the motor's output shaft will rotate. The rotating motor shaft will, by way of the indicated gear train, cause eccentric means EM to rotate, thereby actuating contactor assembly CA, as well as switch means SM, once for each revolution of EM. At a first point during each revolution, just before contactor lever CL1 is about to make electrical connection with contactor lever CL2, switch means SM opens; at a second point during each revolution, just before contactor lever CL1 is about to provide for electrical disconnection from contactor lever CL2, switch means SM closes. Each time switch means SM opens or closes, it provides a command to the IC to discontinue providing power to the motor.

Programming of the timer is accomplished as follows:

(a) Current time-of-day is programmed into the clock by first momentarily depressing PK3, and then by depressing the hour-roll key PK1 and the minute-roll key PK2 until the correct hour and minute are displayed on the numeric display means NDM. After correct current time-of-day is reached, PK3 is depressed once more, thereby securing the time-of-day setting.

(b) A first time-of-day for the load to be switched ON is established by: (i) momentarily depressing PK4; (ii) by way of PK1 and PK2, selecting the first desired time-of-day at which the load should be turned ON; and (iii) momentarily depressing PK4 again, thereby securing this particular instruction.

(c) A first time-of-day for the load to be switched OFF is established by: (i) momentarily depressing PK5; (ii) by way of PK1 and PK2, selecting the first desired time-of-day at which the load should be turned OFF; and (iii) momentarily depressing PK5 again, thereby securing this particular instruction.

(d) A second time-of-day for the load to be switched ON and a second time-of-day for the load to be switched OFF can be programmed into the timer by way of the PK6 key and the PK7 key, respectively, in the same manner as described above relative to the PK4 key and the PK5 key.

(e) The PK8 key and the PK9 key may be used for providing various effects relating to time-variability of the keyed-in program. However, these effects have no relationship with the present invention.

(f) During the process of selecting a given time-of-day for an ON-switching or an OFF-switching to occur, the numeric display means provides for a display of the time-of-day being selected. After the selection has been accomplished and secured, however, the numeric display means reverts back to displaying current time-of-day.

(g) The PORK1 key and the PORK2 key are permanently programmed. After depressing the PORK1 key, the timer will be in the ON-state, regardless of the state in which it previously existed; after depressing the PORK2 key, the timer will be in its OFF-state, regardless of the state in which it previously existed.

Otherwise, the following details with respect to the timer's operation should be noted.

(h) When plugged into the timer, remote control means RCM is operable by way of a simple momentary contact means to reverse the state of the timer. Thus, this RCM may be used to operate the timer from a location remote from the receptacle into which the timer is plugged. It is noted that there is full electrical isolation between the power line at the receptacle and the wires connecting the RCM; which implies that remote control cord RCC may be an ordinary telephone cord.

(i) In respect to the size of subject timer, it is noted that with the components described, its volume need not be any larger than about 70 cubic-centimeters; which compares with about 280 cubic-centimeters for an ordinary plug-in timer, such as for instance may be bought from Intermatic Incorporated in Spring Grove, Ill. 60081.

(j) The positioning of switch means SM relative to eccentric means EM is important, not only to achieve accuracy in the actuation of contactor assembly CA, but also for the purpose of minimizing actuation time. Ideally, switching of the load should occur immediately upon command. Yet, due to the limited spped/power of the DC motor, a certain time is required to effect actuation of the contactor assembly. By positioning switch means SM optimally, actuation time can be made acceptably brief.

(k) In its preferred embodiment, subject timer has a built-in 24-hour cycle; which is to say that whatever switching control pattern that is programmed into this timer will automatically repeat every 24 hours. However, it is readily possible to provide for other programming periods. For instance, in many cases a seven-day cycle would be advantageous.

It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. A combination comprising:

contactor means having a pair of electrical terminals and being operable to exist in either of two states: (i) a state wherein electric current is permitted to flow freely between said terminals, and (ii) a state wherein electric current is prevented from flowing freely between said terminals; said contactor means being operable at any given time, on receipt of a mechanical actuation input, to change from one of said states to the other of said states, regardless of the nature of the particular state in which it exists at said given time;

actuator means operable each time on receipt of a discrete electrical actuation input to provide said mechanical actuation input;

electric energy means operative to supply electric power without having to be connected with an electric utility power line;

clock means connected with said electric energy means and operable to provide an accurate clock signal;

programming means connected with said electric energy means and with said clock means, and operative to provide said discrete electrical actuation input repeatedly in accordance with a presetable program referenced to time-of-day; and structure means operative to support and hold together in substantially rigid relationship said contactor means, said clock means, and said programming means;

whereby said contactor means is at certain selected times caused to permit current to flow freely between said terminals, and at certain other times caused to prevent such flow of current.

2. The combination of claim 1 wherein said programming means comprises programming input means receptive of programming instructions productive of establishing and/or modifying said program.

3. The combination of claim 1 wherein said programming means comprises programming input means receptive of manual programming instructions productive of establishing and/or modifying said program.

4. The combination of claim 1 having display means productive of providing visually discernible information in respect to said program and/or in respect to current time-of-day.

5. The combination of claim 1 wherein said actuator means comprises DC electric motor means.

6. The combination of claim 1 wherein said clock means comprises a quartz element.

7. The combination of claim 1 wherein said electric energy means comprises an electric battery.

8. The combination of claim 1 wherein said actuator means requires input of electric power for but a brief period each time it provides said mechanical actuation input.

9. The combination of claim 1 and auxiliary input means connected with said programming means and operable at any point in time, upon receipt of an auxiliary actuation signal, to cause said discrete electrical actuation input to be provided, thereby causing said contactor means to change from one of said states to the other of said states, regardless of the state in which it exists at said point in time.

10. The combination of claim 1 comprised within a housing means that also comprises: (i) electrical prong means electrically connected with one of said pair of electrical terminals and adapted to be inserted into and held by an ordinary household receptacle, and (ii) electrical receptacle means connected with the other one of said pair of electrical terminals and adapted to receive and hold an ordinary electric power plug.

11. The combination of claim 10 wherein said housing means additionally comprises auxiliary receptacle means connected with said programming means and operable to receive and hold an auxiliary plug.

12. The combination of claim 11 wherein said auxiliary plug is operative during any given period of time to receive an actuation signal productive, by way of said programming means and said actuator means, of causing said contactor means to change from one of said states to the other of said states, regardless of the state in which it existed just prior to said given period of time.

13. A plug-in programmable timer comprising:

substantially rigid housing means;

plug means fastened to said housing means, said plug means having a first pair of electric terminals and being operable to be inserted into and held by an ordinary household electrical receptacle, thereby to provide power line voltage between said first pair of terminals;

receptacle means fastened to said housing means, said receptacle means having a second pair of electric terminals and being operable to receive and hold an ordinary power plug, said power plug being operable to provide power to a load;

contactor means connected in circuit between said pairs of terminals and operable to exist in either of two states: (i) a state wherein electric power is permitted to flow freely between said pairs of terminals, and (ii) a state wherein electric power is prevented from flowing freely between said pairs of terminals; said contactor means being operable at any point in time, on receipt of a discrete mechanical actuation input, to change from one of said states to the other of said states, regardless of the state in which it existed prior to said point in time;

actuator means comprising DC electric motor means and being operable each time on receipt of a discrete electrical actuation input to provide said discrete mechanical actuation input;

electric energy means disposed substantially within said housing means and operable to supply electric power independently of any voltage that might exist between said first pair of electric terminals;

clock means disposed substantially within said housing means, said clock means being connected with said electric energy means and operable to provide an accurate clock signal; and programming means disposed substantially within said housing means, said programming means being connected with said electric energy means and with said clock means, and operative to provide said discrete electrical actuation input repeatedly in accordance with a presetable program referenced to time-of-day;

whereby said contactor means is at certain selected times caused to permit electric power to flow freely between said pairs of terminals, and at certain other times caused to prevent such flow of electric power.

14. The timer of claim 13 having display means connected with said programming means and operable to provide visually discernible information in respect to said program and/or in respect to current time-of-day.

15. The timer of claim 13 wherein said programming means has programming input means receptive of programming instructions operative to establish and/or modify said program.

16. The timer of claim 15 having manual means for receiving said programming instructions.

17. A combination comprising:

contactor means having a pair of electrical terminals and being operable to exist in either of two states: (i) a state in which electric current is permitted to flow freely between said terminals, and (ii) a state in which electric current is prevented from flowing freely between said terminals; said contactor means being operable at any point in time, on receipt of a mechanical actuation input, to change between said states;

actuator means operable on receipt of a discrete electrical actuation input to provide a mechanical actuation input to said contactor means;

battery means operative to supply electric power without having to be connected with an electric utility power line;

clock means connected with said battery means and operable to provide an accurate clock signal;

programming means connected with said battery means and with said clock means, and operative to provide said discrete electrical actuation input repeatedly in accordance with a presetable program referenced to time-of-day; and structure means operative to support and hold together in substantially rigid relationship said contactor means, said clock means, and said programming means;

whereby said contactor means is at certain selected times caused to permit current to flow freely between said terminals, and at certain other times caused to prevent current from flowing freely between said terminals.

18. The combination of claim 17 wherein said actuator means comprises DC electric motor means.

19. The combination of claim 17 with the addition of a display means connected in circuit with the clock means and the programming means.

20. The combination of claim 17 wherein said programming means has manual input means operative to accept manual instructions productive of establishing at least part of said presetable program.

* * * * *